United States Patent [19]

Moore

[11] Patent Number: 4,978,277

[45] **Date of Patent: * Dec. 18, 1990**

[54] REGENERATIVE TURBOMACHINE

[76] Inventor: Alan Moore, 4 Partickhill Avenue, Glasgow G11 5AA, Scotland

[ * ] Notice: The portion of the term of this patent subsequent to Mar. 4, 2003 has been disclaimed.

[21] Appl. No.: 384,997

[22] Filed: Jul. 25, 1989

[30] Foreign Application Priority Data

Jul. 26, 1988 [GB] United Kingdom ..... 8817789

[51] Int. Cl.[5] ..... F01D 1/12

[52] U.S. Cl. ..... 415/57.1; 415/55.6

[58] Field of Search ..... 415/55.1, 55.5, 55.6, 415/57.1, 57.2, 57.4, 175, 179, 56.5

[56] References Cited

U.S. PATENT DOCUMENTS

| | | | |
|---|---|---|---|
| 791,949 | 6/1905 | Scheuber | 415/57.1 |
| 2,809,493 | 10/1957 | Pavlecka | 415/57.4 |
| 3,138,363 | 6/1964 | Banerian | 415/119 |
| 3,869,220 | 3/1975 | Tayler | 415/57.1 |
| 3,951,567 | 4/1976 | Rohs | 415/57.1 |
| 4,167,854 | 9/1979 | Diemer et al. | 415/57.2 |
| 4,441,855 | 4/1984 | Tayler | 415/57.1 |
| 4,573,864 | 3/1986 | Moore | 415/57.1 |

FOREIGN PATENT DOCUMENTS

| | | | |
|---|---|---|---|
| 0135365 | 8/1984 | European Pat. Off. . | |
| 915217 | 6/1954 | Fed. Rep. of Germany . | |
| 2258737 | 6/1974 | Fed. Rep. of Germany . | |
| 324837 | 9/1902 | France . | |
| 443631 | 12/1948 | Italy | 415/57.4 |
| 467196 | 7/1975 | U.S.S.R. | 415/57.4 |
| 720193 | 3/1980 | U.S.S.R. | 415/57.4 |

*Primary Examiner*—John T. Kwon

*Attorney, Agent, or Firm*—Ratner & Prestia

[57] ABSTRACT

A regenerative turbomachine has a rotatable bladed impeller (1) and an annular housing (3) surrounds the impeller (1) and defines a topological flow channel for a working fluid. There is also an inlet port (4) for admitting a working fluid to the housing (3) and an outlet port (5) spaced circumferentially of the impeller (1) from the inlet port (4) by which the working fluid can leave the housing (3). A guide is also provided for guiding the working fluid entering the inlet part (4) through a slip flow path and a counter-flow path which follow respective spiral paths in opposite directions around the toroidal flow channel. Each flow path makes a number of successive passes through the impeller (1) and each successive pass is spaced circumferentially from the other passes.

8 Claims, 9 Drawing Sheets

REGENERATIVE TURBOMACHINE

This invention relates to regenerative turbomachines, and more particularly but not exclusively concerns improvements in or modifications of the counter-flow regenerative turbomachines described in Patent Specification number EP-0,135,365-A.

BACKGROUND OF THE INVENTION

In regenerative pumps or compressors of known form, fluid to be pressurised or compressed passes through an inlet port either axially or obliquely into an annular housing or shroud which surrounds a bladed rotor. Within the shroud there is also contained an annular core which is supported in such a way as to be spaced from the rotor blades and from the walls of the shroud. The blading is so designed that air (or other working fluid) is drawn into and passes around the annular shroud with a spiral motion around the core in the general direction of rotor rotation. In circulating around the core, the fluid makes repeated passes through the blading in a generally axial sense, and at each pass the pressure of the fluid is thereby increased. A fluid outlet port is provided just before the inlet port, by which the pressurised fluid can leave the shroud. Between the inlet and outlet ports there is provided a stripper which blocks passage of gas around the shroud, and conforms closely to the blade tips so as to minimise leakage of pressurised fluid, which has completed a circuit of the shroud, to the inlet port.

The conventional regenerative compressor is capable of generating a pressure ratio of the order of 2:1 but only at a low isothermal efficiency of the order of 25–35%, depending upon flowrate and design of machine. An isothermal efficiency approaching 60% is attainable, but only at a low pressure ratio, perhaps of the order of 1.2:1.

The conventional regenerative compressor is thus not a very efficient machine, and a great deal of the inefficiency is attributable to losses in the region of the stripper, in particular to (i) leakage past the stripper which sustains the full pressure difference between inlet and outlet ports, and (ii) carry-over in the blade pockets of fluid at outlet pressure back to the inlet.

Very high solidity designs have been produced with the object of reducing carry-over, but this has led to high viscous losses, and hence little or no net gain in efficiency. Similar considerations apply to conventional regenerative pumps.

The present invention aims to provide a regenerative turbomachine in which the need for a stripper is avoided, and hence the losses associated therewith can also be avoided.

SUMMARY OF THE INVENTION

Accordingly the present invention provides a regenerative turbomachine comprising:

a rotatable bladed impeller, an annular housing surrounding the impeller and defining a topologically toroidal flow channel for a working fluid, an inlet port for admitting working fluid to the housing, an outlet port spaced circumferentially of the impeller from the inlet port, by which the working fluid can leave the housing, and guide means for guiding the working fluid entering the inlet port through a slip flow path and a counter-flow path which follow respective spiral paths in circumferentially opposite directions around said toroidal flow channel, each flow path making successive passes through the impeller blading in a generally radial sense, wherein in the slip flow path successive passes are made which reintroduce the working fluid to the rotor blades at circumferential positions spaced successively in the direction of intended impeller rotation, and in the counter-flow path successive passes are made which reintroduce the working fluid to the impeller blades at circumferential positions spaced successively in the direction counter to the intended direction of impeller rotation.

While the impeller blades may intersect the toroidal flow channel in a circumferential strip which is located at any predetermined position around the toroid, it is preferred in the case of a compressor that the impeller blades are positioned to induce radial outflow around the toroidal flow channel.

The slip flow path and the counter-flow path are preferably brought together in the region of the outlet port, although conceivably each path might have a respective outlet port which are mutually separate.

The invention has greatest advantage when the turbomachine is utilised as a compressor for a gas or other compressible working fluid.

Preferably there are provided one or more heat exchangers in one or both of said flow paths for removing heat of compression after at least one of said successive passes.

A gap upstream of the impeller is preferably used to control the incidence at the inlet to the impeller in the transition zone between each pass through the impeller. It is in the nature of the flow of the working fluid that such a gap will be beneficial in both slip and counter-flow paths to serve to maintain constant or near constant lift on each impeller blade as it traverses each transition zone.

The guide means may include one or more flow splitter vanes at the inlet port for assisting in distributing the working fluid between the slip flow path and the counter-flow path.

Additional guide vanes may be used in each pass upstream of the impeller to ensure that the preferred inlet flow angle is maintained.

BRIEF DESCRIPTION OF THE DRAWINGS

The invention will now be described by way of example only with reference to the accompanying drawings, of which.

DESCRIPTION OF PREFERRED EMBODIMENTS

Figure 1:
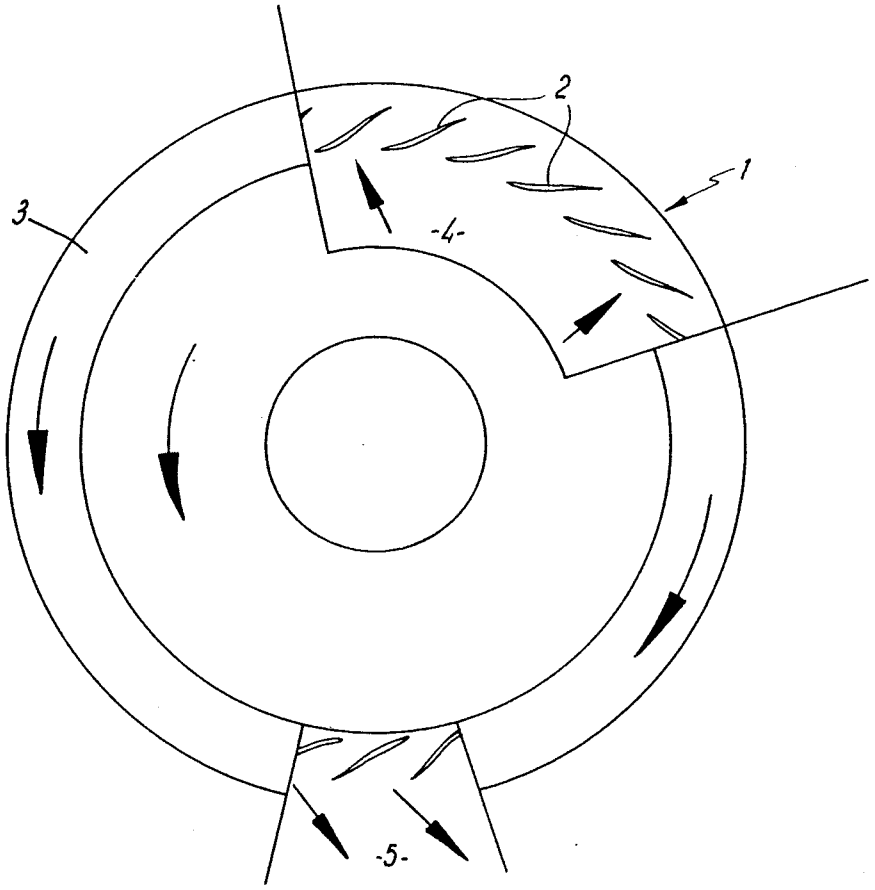
FIG. 1 is a simplified schematic view of a regenerative turbomachine illustrating the principle of the present invention.
Figure 2:
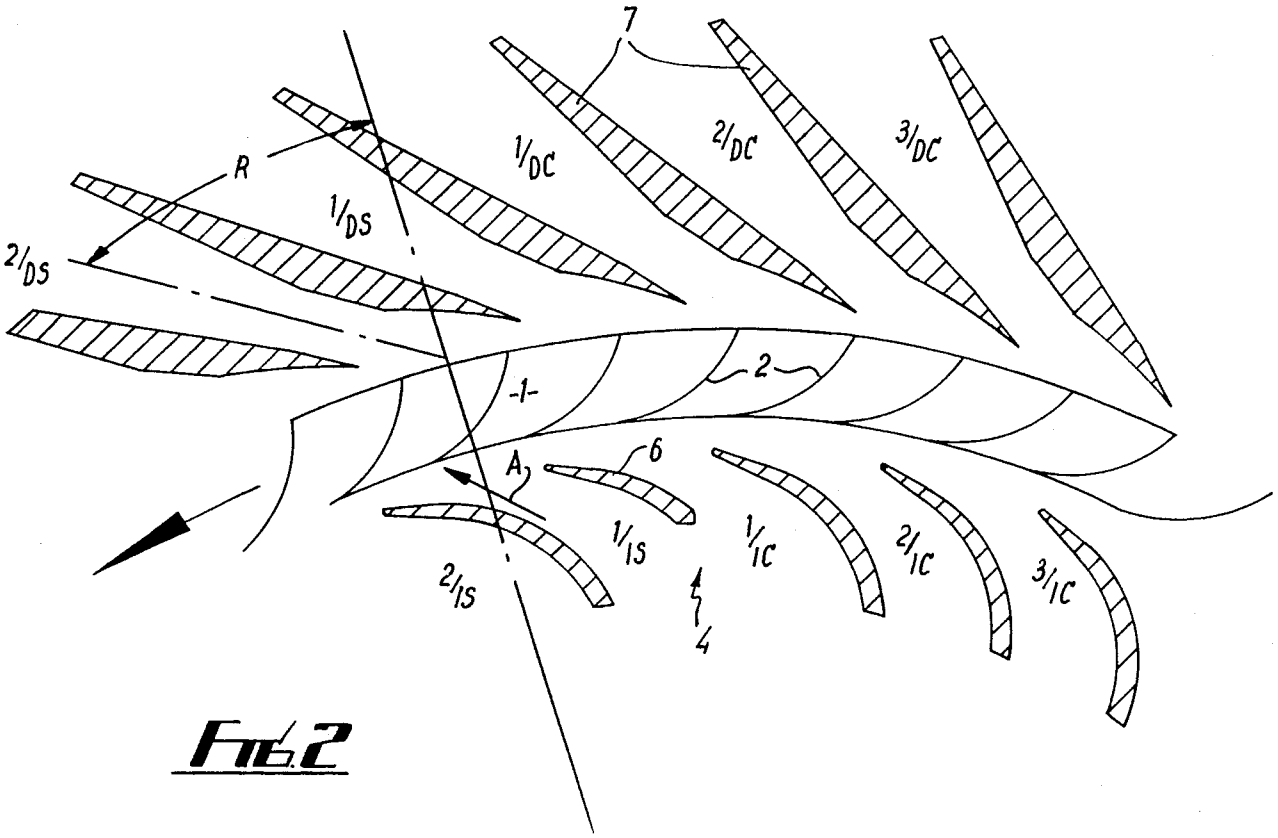
FIG. 2 is a simplified schematic view representing a section in the radial plane on the mean surface of the impeller through part of the turbomachine of FIG. 1.
Figure 3:
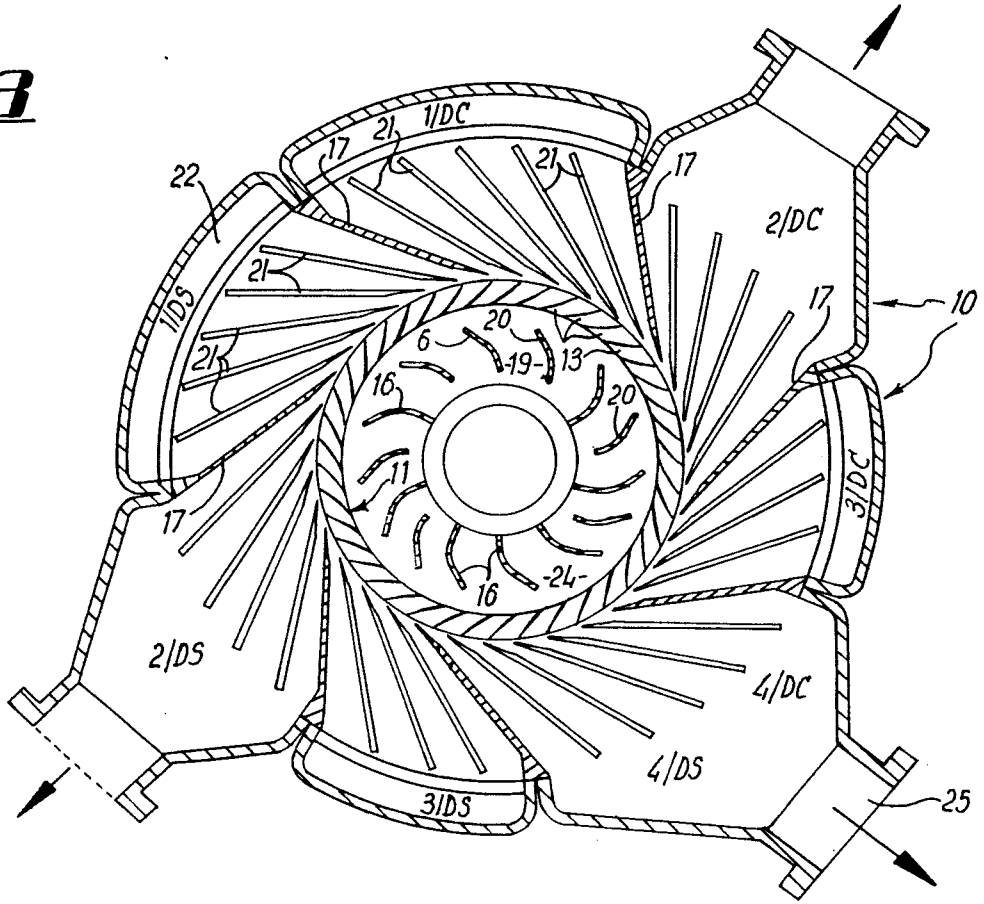
FIG. 3 is a section through the mid plane in the impeller and the associated inlet and diffusing passages, taken on line III—III in FIG. 4.

As shown schematically in FIGS. 1 and 2, a regenerative turbomachine in accordance with the invention comprises a radial outflow impeller 1 provided with blades 2 around its periphery. An annular housing 3 surrounds the impeller 1 and defines a toroidal flow channel for a gas or other working fluid. As will be detailed below, while the shape of the flow channel may substantially depart from a pure toroid, the flow channel retains topological identity with a toroid. In some embodiments, the toroidal flow channel may be duplicated in cascade, as two back-to-back toroids for use as a multi-stage compressor with two impellers. The housing 3 is provided with an inlet port 4 and an outlet port 5 for the working fluid. At the inlet port 4 there may be division of the incoming working fluid between a slip flow path 1/IS and a counter-flow path 1/IC. The working fluid enters the housing 3 via the inlet port 4 at a leading angle "A" to the radial direction. In a high pressure, high speed turbocompressor the angular velocity component will preferably be in the direction of impeller rotation to reduce the relative inlet Mach number. As the working fluid passes through the impeller blading 2, work is done on each stream of fluid. The working fluid makes a pass in a radially outward sense through the impeller blading 2, but inclined at an angle to the radial vector, and is received and guided by a series of diffusing passages 1/DS, 1/DC, 2/DC etc., in the radial plane, defined by a series of guide vanes or pass walls 7. Each pass may be subdivided by a series of vanes into a multiplicity of diffusers (e.g. as shown in FIG. 3) each diffuser being inclined at an angle to the radial direction which is not necessarily identical to the general inclination of the flow of working fluid through the impeller blading 2. TYpically the preferred diffuser setting angle "R" lies between 70 degrees and 50 degrees to the radial direction. Fluid travelling in the slip flow direction is initially collected in the passage 1/DS, and is guided to re-enter the impeller blading 2 through a path 2/IS at a location displaced from the inlet 4 in the slip direction. After a plurality of such passes the fluid is directed to discharge via the outlet port 5.

The working fluid in the counter-flow path is initially collected in the diffusing passage 1/DC after passing through the impeller blading 2 in a generally radially outward sense. This working fluid is guided to make a second pass through the blading via a path 2/IC which reenters the impeller blading 2 at a location displaced from the inlet 4 in the counter-flow direction. Fluid travelling in the counter-flow direction is next collected in the diffusing passage 2/DC, and re-enters the blading 2 at 3/IC etc. After a plurality of such passes, with the working fluid leaving and re-entering the impeller blading 2 at points displaced successively in the counter-flow direction, the working fluid is directed to discharge via the outlet port 5.

The fluid pressure at the outlets of slip and counter-flow paths thus must be the same and the fluid flows through the two paths are thus self-balancing. It is not necessarily the case that the fluid in the two paths will make the same number of circuits (i.e., passages through the impeller blading). The need for a stripper to block outlet and inlet is obviated along with its attendant disadvantages. It will be appreciated that not all working fluid entering by a particular inlet passage will necessarily leave by any particular outlet passage at each pass; there will be some leakage and carry-over.

Figure 4:
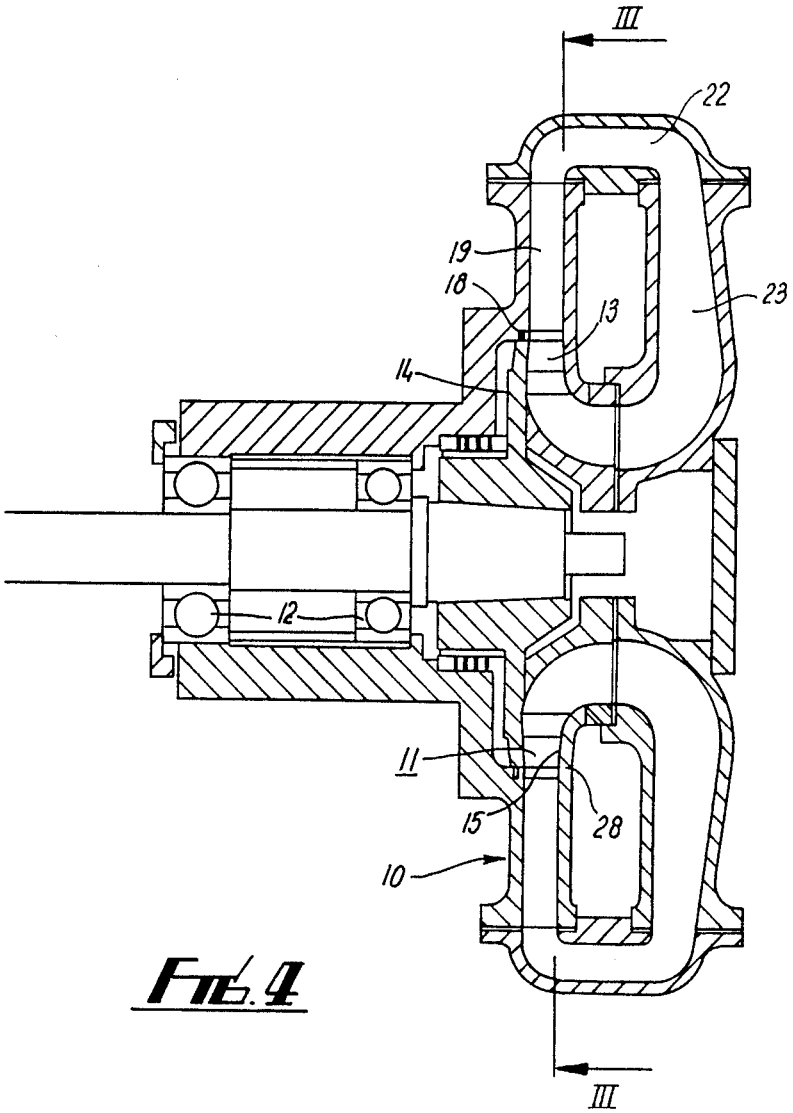
FIG. 4 is a sectioned elevation of the turbomachine in a plane through its axis.

In FIG. 3 there is shown a sectioned view through the axis of a regenerative compressor featuring a centrifugal type of impeller and embodying the principles described with reference to FIGS. 1 and 2. As seen in FIG. 3, a regenerative compressor comprises a casing 10 in which there is supported an impeller 11 by means of bearings 12 (see FIG. 4). The impeller 11 is intended to rotate in an anti-clockwise direction as viewed in FIG. 3. The impeller 11 carries a plurality of blades 13. Shown in FIG. 4 is a sectioned elevation through the same compressor. The casing 10 with the impeller 11 and the impeller backplate 14 forms an annular housing. The clearance 15 between the impeller blades and the casing 10 is kept small. Flow on each pass through the machine is constrained by passage walls 16 and 17. The gap between the upstream passage wall 16 and the leading edge of the impeller blades 13 is used to control the incidence on the impeller blade as it passes through the pressure gradient in the transition zone between passes through the compressor. A gap between the passage wall 16 on the inlet side and the impeller blade leading edge will in the counter-flow path deflect the fluid in such a manner as to unload the blade, thus avoiding stalling. Similarly the gap in the slip flow path will increase the loading on the blade as it passes through the transition zone between passes, thus compensating for a loss in lift due to the transverse pressure gradient in this zone.

The change in incidence required is a function of the local pressure gradient, dp/dx. With a pressure gradient of this value at the impeller blade leading edge then the change in incidence at each transition zone should be such as to yield an incremental change in blade lift of approximately:

$$s\frac{dp}{dx} = \frac{\cos Bm \cos y}{\frac{1}{2}\rho(VR)^2}$$

where s = blade spacing y = blade stagger angle $\frac{3}{4}$ = local fluid density VR = radial velocity component Bm = (B1 + B2)/2

B1 is an inlet flow angle

B2 is an outlet flow angle

Figure 6:
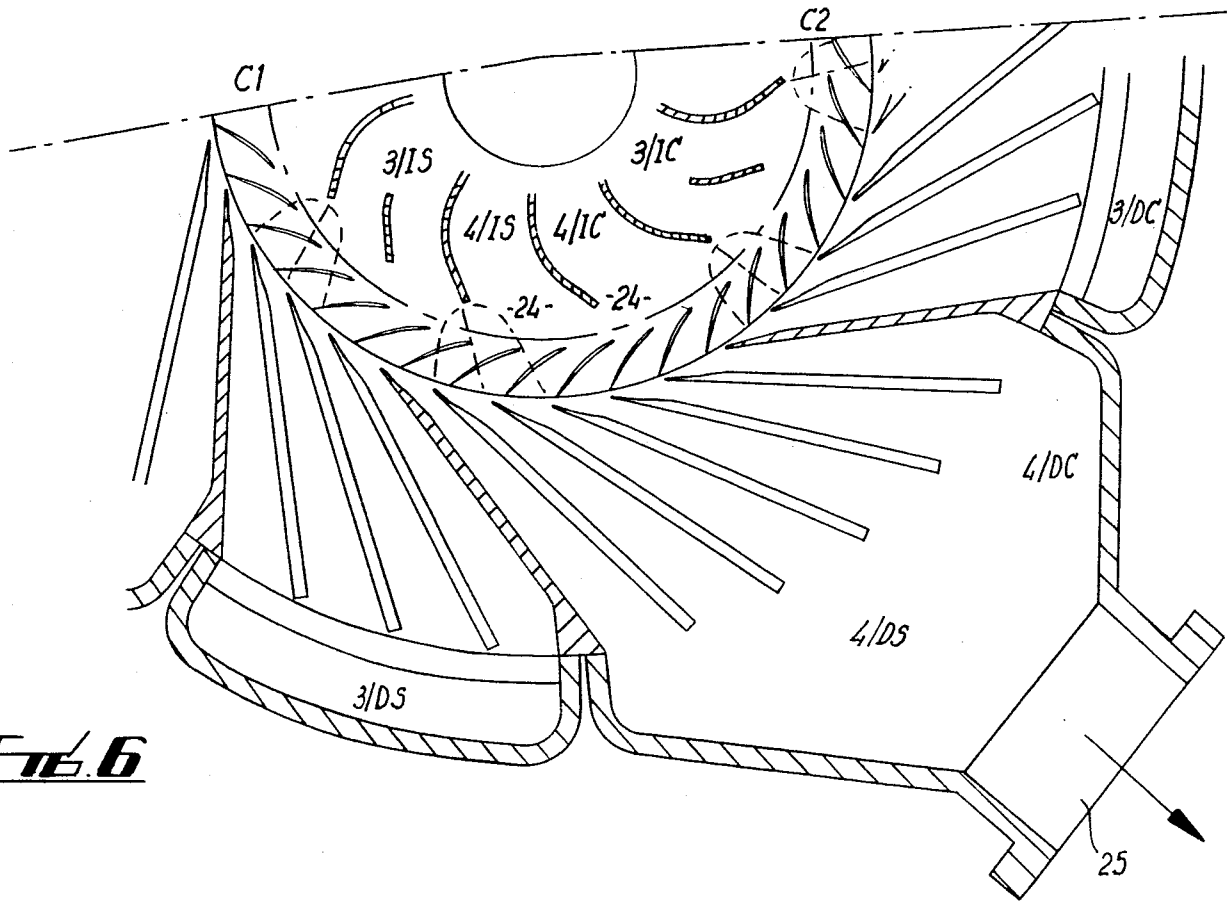
FIG. 6 is a partial section through the mid plane in the impeller and the associated inlet and diffusing passages illustrating diagrammatically the nature and position of the transition zones between passes.
Figure 7:
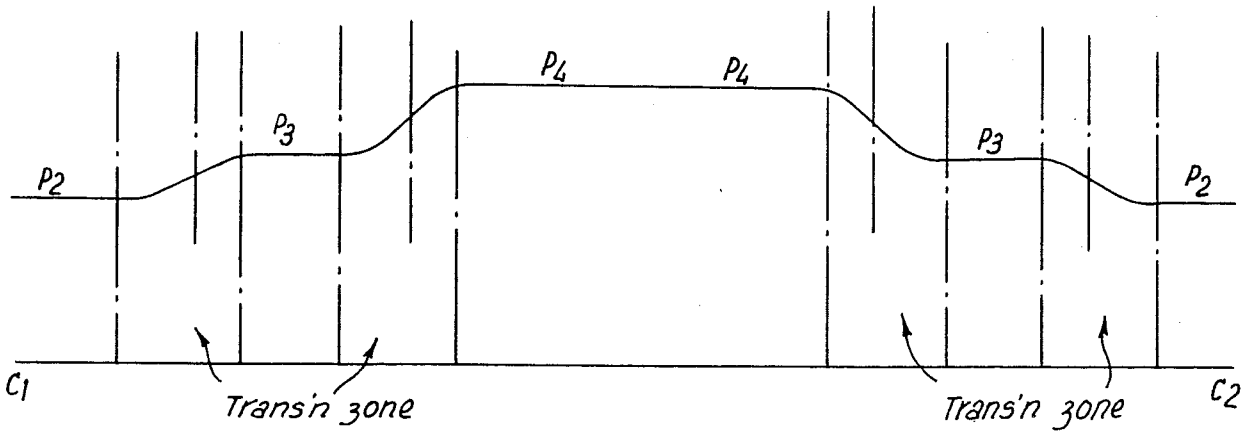
FIG. 7 is a diagrammatic representation of pass pressure distributions further illustrating the transition zones between passes.

Shown in FIG. 6 are the transition zones between passes in the region of the discharge port in the four-pass regenerative compressor of FIGS. 3 and 4. In FIG. 7 the distribution of the transverse pressure gradient on the circular arc marked C1–C2 in FIG. 6 is shown diagrammatically. In FIG. 4 are shown gas seals 18 which are provided between the backplate 14 and the casing 10 to prevent escape of gas from the housing. The gas seals 18 should be designed so that in addition to their conventional sealing function they also inhibit leakage in the circumferential direction from the high to low pressure parts of the turbomachine compressor.

Figure 5:
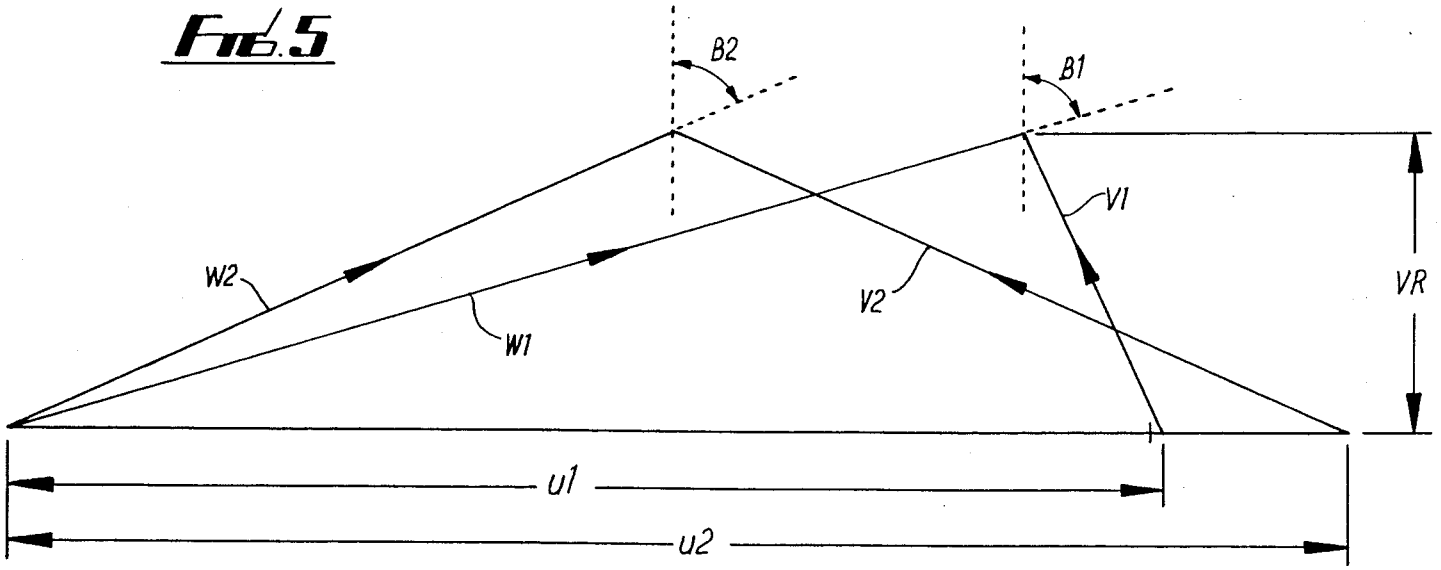
FIG. 5 are typical velocity triangles representing flow of the working fluid through the impeller outwith the transition zones for both slip and counter-flow paths for the turbomachine of FIG. 3 and FIG. 4 when operating as a compressor.

Gas can be admitted to the housing 10 via an inlet manifold (not shown) which leads to an inlet port 19 which communicates with the section of the annular housing containing the impeller blades 13. A series of guide vanes 20 direct the flow at the appropriate angle towards the impeller. The velocity triangles for both flow streams are shown in FIG. 5, where u1 represents the impeller blade peripheral velocity at the leading edge and u2 that at the outer radius, i.e. at the impeller blade trailing edge. The absolute inlet velocity vector is denoted V1 and that at the impeller blade trailing edge by V2. The mean radial velocity vector is VR, while velocities relative to the impeller at inlet and outlet are denoted W1 and W2 respectively. As shown, the velocity triangles call for preswirl in the direction of impeller rotation. This need not necessarily be so but the inlet guide vanes can advantageously provide preswirl in both slip and counterflow directions.

The guide vanes 20 in this instance serve to direct the inlet flow in the slip flow direction. The working fluid passes through the impeller blading 13 where work is performed thereon to increase its pressure, and in this example leaves the impeller blading at a location substantially radially opposite the inlet. Fluid is collected in the slip and counter-flow passages 1/DS and 1/DC which are separated from each other by the wall 17. Within the passages are fitted additional vanes 21 designed to assist in controlling the diffusion of flow of the working fluid. Both the vanes 21 and the passage walls 17 are inclined at an angle to the radial direction which is determined by the design angle of the discharge flow vector V2. The setting angle of the diffusers may be different in slip and counter-flow paths in order to account for different effect of unguided diffusion in the space between the impeller discharge and the inlet to the diffusers. The slip flow and the counter-flow are guided by the diffusing passage walls 17 and the inlet guide passage walls 16 so as to make repeated passes through the impeller blading 13 in a substantially radially outward direction, as described with reference to FIGS. 1 and 2. The pressure of the gas is increased at each pass as a result of the work performed thereon by the impeller blades 13.

The slip flow thus for example enters at the inlet port 19, its pressure is increased by passage through the blades 13 of the rotating impeller 11, and it leaves the annular housing 10 in the slip direction. The fluid in the diffusing passage 1/DS is guided by the internal vanes 21 until maximum diffusion is obtained. The fluid stream contained in passage 1/DS by the walls 17 is fed into the turning section 22 wherein it is turned through 180 degrees and then led via a passage 23 between walls separating it from adjacent passes through the machine, to re-enter the impeller blading 13 via the second slip inlet 2/IS which is displaced circumferentially in the slip direction from the inlet 19 although some leakage and carry over will occur in practice. Then the slip flow again passes through the impeller blading 13 where its pressure is further increased. Guided diffusion then takes place in the diffusing passage 2/DS. After the controlled diffusion is completed the fluid is directed in the example shown via the discharge 2/DS to a heat exchanger (not shown) which functions as an intercooler to enable most of the heat introduced by the compression process to be removed. Fluid is then returned via the third slip inlet 3/IS which is displaced circumferentially in the slip direction from the second slip inlet 2/IS. The process is then repeated through a plurality of such passes, with or without diversion through an intercooler between passes, as is required until the outlet port is reached. Flow in the counter-flow direction proceeds similarly; fluid from the first counter-flow diffusing passage 1/DC is guided around to the second counter-flow inlet and thence through the impeller blades 13. Fluid from the second counter-flow diffusing passage 2/DC is diverted in the FIG. 3 embodiment to an intercooler (not shown). The intercooler may or may not be the same one as used in the slip path. If the design is balanced with pressure in each pass in each direction designed to be the same then it may be advantageous to interconnect slip and counter-flow intercoolers in order to ensure that the pressures in the corresponding passes are constrained to be equal. On discharge from the intercooler the fluid in the counter-flow stream is guided round to the third inlet 3/IC, which is displaced circumferentially in the counter-flow direction from the inlet 2/IC.

The immediate vicinity of the discharge port 24 of a four-pass single impeller machine is illustrated in FIG. 6. Fluid from the third slip flow pass 3/DS is led to the fourth inlet 4/IS where it is joined by fluid from the third counter-flow pass 3/DC in the inlet 4/IC immediately alongside it. These two flow components combine and enter the impeller blades wherein the pressure and momentum are increased. On leaving the impeller the bulk of the combined stream is discharged into the combined diffusing passage designated 4/DS and 4/DC. On reaching the end of the controlled diffuser the two streams are discharged from the discharge pipe 25 to either another impeller or finally from the turbomachine. Another cooler may be fitted at this point, fulfiling the role of intercooler or aftercooler as appropriate.

Figure 9:
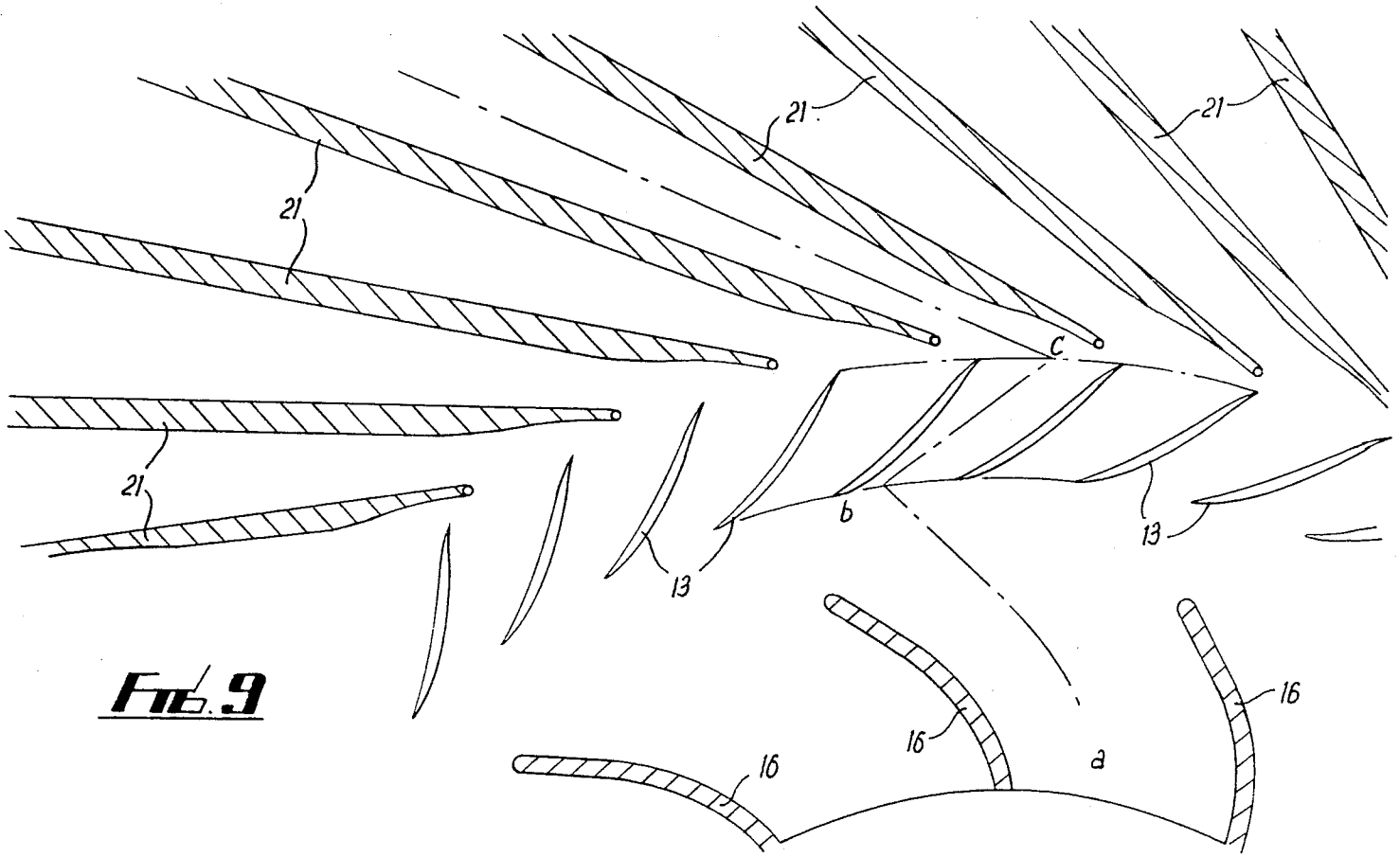

In a counter flow compressor it is advantageous that the design of the machine is such that effort is made to maintain optimum flow in the impeller throughout a revolution. To do this the position of each pass downstream of the impeller is located in such manner to that pass corresponding to it on the upstream side that equilibrium flow is maintained. Referring to FIG. 9 the design streamline for a typical pass through the impeller is sketched. Upstream the path of the particle leaving the upstream passage walls 16 is tracked between a and b. Through the impeller the streamline is that corresponding to the optimum streamline having mean flow angle $Bm = (B1+B2)/2$ as shown assuming equilibrium flow in the impeller, that is as sketched from b to c. The inlet and outlet flow angles B1 and B2 are shown in the velocity triangles in FIG. 5.

The path of the particle downstream is then followed on exit from the impeller. With a backward curved compressor impeller as shown it will be noted that the downstream pass is then skewed relative to that upstream in the direction opposite to that of rotation. Note this is opposite to known forms of multi-pass regenerative compressor, such as Tayler, U.S. Pat. No. 3,869,220 March 1975 where the design path is based on the absolute path of the particle through the impeller. In this case the downstream pass is skewed relative to that upstream in the direction of rotation.

The gap between the trailing edge of the upstream pass wall 16 and the leading edge of the impeller blades 13 is designed to compensate for the change in blade loading experienced as the impeller blade 13 passes through the pressure gradient between passes. The fluid angle is altered locally and the incidence on the impeller blade 13 reduced in the counter flow path by an amount sufficient to ensure that the blade does not stall. Since the pressure gradient between passes in the slip flow path has the effect of reducing impeller blade lift, that is it is unloaded, the gap then fulfils the opposite function. Fluid is deflected by the pressure gradient when crossing the gap in a manner which increases impeller blade incidence locally, by such an amount that the blade lift is increased to compensate for the loss in lift attributable to the pressure gradient at this point. The intention being to maintain constant or near constant lift upon the impeller blades 13 through a revolution.

In order to minimise the effect of leakage at the boundaries between passes which is a consequence of the equilibrium flow design approach the impeller is designed so that it will be formed from a large number of small blades rather than a smaller number of large blades for any preferred solidity. The minimum size of blades will then be controlled by manufacturing considerations. A prime requirement being to make accurate blade forms with good surface finish.

Figure 8:
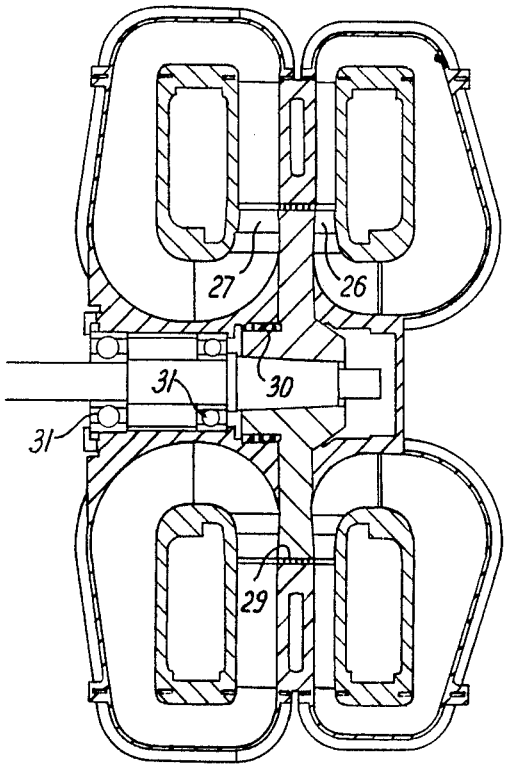
FIG. 8 is a sectioned elevation of a two-stage compressor with two impellers mounted in a back-to-back fashion and operating in cascaded twin toroidal flow channels; and, FIG. 9 shows an example of a design stream line.

Since it is undesirable to have the passes at the discharge from a compressor a great deal narrower than those in the inlet it is advantageous in higher pressure ratio compressors to use more than one impeller. FIG. 8 shows an arrangement where the high pressure ratio impeller 26 is mounted back-to-back with a low pressure impeller 27. The high pressure ratio impeller in this case is shown to be narrower than the low pressure one. It is suggested by way of example that for an overall absolute pressure ratio of 9-to-1 the pressure ratio on each individual impeller would then be chosen to be 3-to-1. It is an advantageous feature of the present invention that the two impellers can be designed to operate at their greatest efficiency while rotating at identical speeds.

Sealing arrangements with the radial configuration of the present invention are simplified when compared with the axial configuration described in Patent Specification number EP-0,135,365-A. As shown in FIG. 3 the impeller runs with minimal clearance between the tips of the blades 13 and the fixed shroud 28 and consequently additional gas sealing in this zone is unnecessary. Gas seals 18 are fitted between the impeller backplate 14 and the casing 10, and in addition to sealing in the conventional sense care should be taken to minimise flow in the circumferential direction. In the back-to-back configuration shown in FIG. 8 radial seals 29 on the impeller backplate isolate the high pressure side from the low pressure side, with an intermediate pressure sustained in the cavity between the two sets of seals. Gas seal(s) 30 on the shaft ensure that the gas compression side is isolated from the lubricated bearings 31.

In the turbomachine of Patent Specification number EP-0,135,365-A, the flow of working fluid through the impeller was generally axial, followed by flow straightening and expansion. This gave an increased probability of undesirable flow separation. The turbomachine of the present invention gives simpler and more controlled diffusion.

While certain modifications and variations of the invention has been described above, the invention is not restricted thereto and other modifications and variations can be adopted without departing from the scope of the invention.

I claim:

1. A regenerative turbomachine comprising:

a rotatable impeller having blades, an annular housing surrounding the impeller and defining a topologically toroidal flow channel for a working fluid, an inlet port for admitting working fluid to the housing, an outlet port spaced circumferentially of the impeller from the inlet port, by which the working fluid can leave the housing, and guide means for guiding the working fluid entering the inlet port through a slip flow path and a counter-flow path which follow respective spiral paths in circumferentially opposite directions around said toroidal flow channel, each flow path making successive passes through the impeller blading in a generally radial sense, wherein in the slip flow path successive passes are made which reintroduce the working fluid to the impeller blades at circumferential positions spaced successively in the direction of intended impeller rotation, and in the counter-flow path successive passes are made which reintroduce the working fluid to the impeller blades at circumferential positions spaced successively in the direction counter to the intended direction of impeller rotation.

2. A regenerative turbomachine according to claim 1, wherein the turbomachine is a compressor.

3. A regenerative turbomachine according to claim 1, wherein the position of the impeller blades is such that the impeller blades induce radial outflow around the toroidal flow channel.

4. A regenerative turbomachine according to claim 1, wherein the slip flow path and the counter-flow path merge at the outlet port.

5. A regenerative turbomachine according to claim 1, further comprising at least one heat exchanger in one of the flow paths.

6. A regenerative turbomachine according to claim 5, wherein there is at least one heat exchanger in each flow path.

7. A regenerative turbomachine according to claim 1, wherein there is a gap upstream of the impeller to control the incidence at the inlet to the impeller.

8. A regenerative turbomachine according to claim 1, wherein the guide means comprises at least one flow splitter vane at the inlet port to assist distribution of the working fluid between the slip flow path and the counterflow-path.

* * * * *